US011439209B1

(12) United States Patent
Guan

(10) Patent No.: US 11,439,209 B1
(45) Date of Patent: Sep. 13, 2022

(54) SEALED ZIPPER TOP STOP

(71) Applicant: WUXI YOUEN TEXTILE CO., LTD., Wuxi (CN)

(72) Inventor: He Guan, Shijiazhuang (CN)

(73) Assignee: WUXI YOUEN TEXTILE CO., LTD., Wuxi (CN)

( * ) Notice: Subject to any disclaimer, the term of this patent is extended or adjusted under 35 U.S.C. 154(b) by 0 days.

(21) Appl. No.: 17/200,881

(22) Filed: Mar. 14, 2021

(30) Foreign Application Priority Data

Feb. 23, 2021 (CN) ..... 202120398513.8

(51) Int. Cl.
*A44B 19/30* (2006.01)

(52) U.S. Cl.
CPC ..... *A44B 19/30* (2013.01)

(58) Field of Classification Search
CPC ..... A44B 19/36; Y10T 24/2514
See application file for complete search history.

(56) References Cited

U.S. PATENT DOCUMENTS 4,825,514 A * 5/1989 Akeno ..... A44B 19/36 24/387
5,253,395 A * 10/1993 Yano ..... A44B 19/265 24/387
8,104,147 B2 * 1/2012 Peano ..... A44B 19/36 24/387
9,314,069 B2 * 4/2016 Takazawa ..... A44B 19/32

* cited by examiner

*Primary Examiner* — Robert Sandy

(57) ABSTRACT

A sealed zipper top stop and a zipper. The sealed zipper top stop includes a body, wherein a groove matched with one end of a slider close to the body is arranged at one side of the body close to the slider; and two elastic clamping tongues, wherein one end of each of the two elastic clamping tongues is arranged at the bottom of the groove, and another end of each of the two elastic clamping tongues extends towards a direction away from the body. The groove matched with the slider is arranged on one side of the body close to the slider, so that the slider can fit closely with the body when moving to the body without creating a gap and the sealing effect is good.

8 Claims, 2 Drawing Sheets

SEALED ZIPPER TOP STOP

TECHNICAL FIELD

The present invention relates to the technical field of zippers, in particular to a sealed zipper top stop.

BACKGROUND

Zippers are generally classified into closed-end zippers, open-end zippers, double-open-end zippers, closed-end zippers with double ends and double sliders, namely "O" shape zippers. Closed-end zippers are mostly used for trousers plackets, pockets and other parts, while open-end zippers and double-open-end zippers are mostly used for jacket plackets. "O" shape zippers are mostly used for bags and suitcases, but less for clothing.

Closed-end zippers are often used on bed packs and some beddings, and a gap is always left at zipper top stops of the existing beddings and bed packs, which allows mites and dust to enter and allows fillers to frequently get out of the gap, so that users will feel uncomfortable after long-term use.

SUMMARY

The purpose of the present invention is to provide a sealed zipper top stop with good sealing effect.

Therefore, a technical solution adopted by the present invention is to provide a sealed zipper top stop, comprising:

a body, wherein a groove matched with one end of a slider close to the body is arranged at one side of the body close to the slider; and two elastic clamping tongues, wherein one end of each of the two elastic clamping tongues is arranged at the bottom of the groove, and the other end extends towards a direction away from the body, and the two elastic clamping tongues are arranged in an inverted splay shape, so that the gap between the two elastic clamping tongues decreases gradually from the end close to the body to the end away from the body;

wherein both sides of the body and one side on which the two elastic clamping tongues deviate from each other are provided with clamping grooves extending along the lengthwise direction of the zipper.

In an example of the present invention, each of the two elastic clamping tongues comprises a clamping side, and the clamping sides of the two elastic clamping tongues are arranged oppositely; each of the clamping sides comprises a holding section, a connecting section and a lead-in section, wherein one end of the holding section is connected with the body, one end of the connecting section is connected with the other end of the holding section, and one end of the lead-in section is connected with the other end of the connecting section; a holding space for holding a top tongue of the slider is formed between the two holding sections and the two connecting sections of the two clamping sides, and a lead-in space for guiding the slider is formed between the two lead-in sections of the two clamping sides, and the size of the holding space is larger than that of the lead-in space.

In an example of the present invention, the holding sections, the connecting sections and the lead-in sections are planar, the two connecting sections are obliquely arranged at the two corresponding holding sections respectively, and ends of the two connecting sections away from the two corresponding holding sections are close to each other.

In an example of the present invention, each of the elastic clamping tongues further comprises a lead-in side adjacent to the clamping side and a sidestep side opposite to the clamping side, and the width between the sidestep side and the clamping side decreases gradually from the end close to the body to the end away from the body.

In an example of the present invention, a first arc chamfer is formed between the clamping side and the lead-in side, and/or a second arc chamfer is formed between the lead-in side and the sidestep side.

In an example of the present invention, the two elastic clamping tongues are provided with guide projections on the upper side and/or the lower side respectively, each of the two guide projections comprises a guide surface, and the guide surfaces of the two guide projections are parallel to each other and extend along the lengthwise direction of the zipper.

In an example of the present invention, each of the guide projections further comprises a stop surface perpendicular to the guide surface.

In an example of the present invention, the sealed zipper top stop further comprises:

a stiffener, arranged on one side of the body away from the slider, wherein the stiffener extends along the lengthwise direction of the zipper, and two sides of the stiffener are provided with the clamping grooves.

The present invention has the following advantageous effects.

Different from the prior art, according to the technical solution of the present invention, the groove matched with the slider is arranged on one side of the body close to the slider, so that the slider can fit closely with the body when moving to the body without creating a gap, and the sealing effect is good. With a compact structure, the sealed zipper top stop can effectively prevent mites and dust from getting in and out or fillers from overflowing when in use, and is thus very suitable for popularization. The two elastic clamping tongues arranged in the groove can be inserted into lead-in inlets on both sides of the top tongue of the slider to clamp and fix the slider, thereby preventing the slider from loosening.

BRIEF DESCRIPTION OF THE FIGURES

For clearer description of the preferred examples in the present invention or the technical solutions in the prior art, figures incorporated for illustrating the preferred examples or the prior art are briefly described hereinafter. Obviously, the figures in the following description are only some examples of the present invention, and for those of ordinary skill in the art, other figures may also be obtained based on these figures without creative effort.

DESCRIPTION OF THE INVENTION

Figure 1:
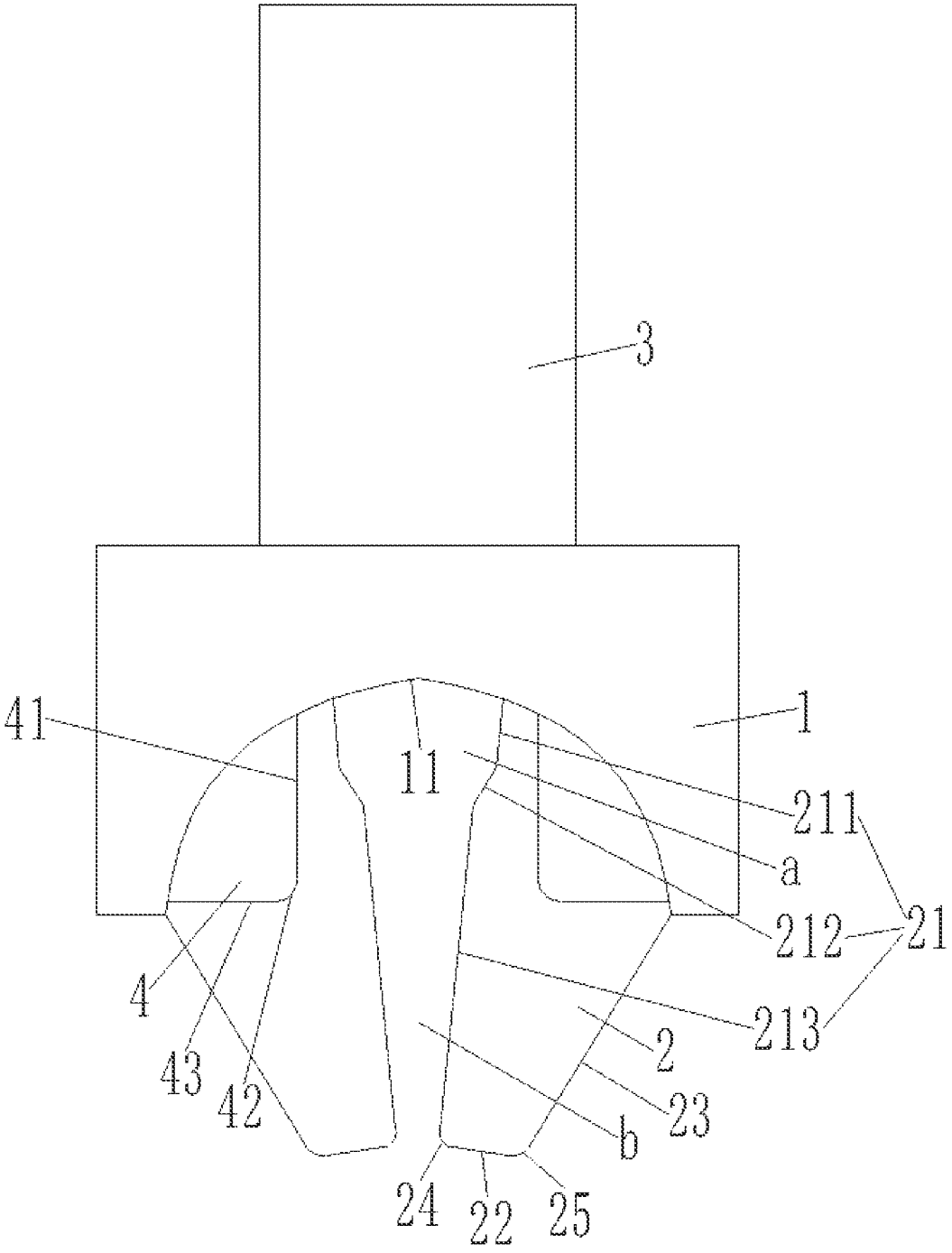
FIG. 1 is a top view of a sealed zipper top stop according to an example of the present invention.

The preferred examples of the present invention will be described in detail with reference to accompanying drawings for clear understanding of the above purpose, features and advantages of the present invention. In the following description, numerous specific details are set forth in order to provide a thorough understanding of the present invention. However, the present invention can be implemented in many other ways different from those described here, and those skilled in the art can make similar improvements without violating the connotation of the present invention, so the present invention is not limited by the examples disclosed below.

In the description of the present invention, it should be understood that the orientation or position relationship indicated by the terms "central", "longitudinal", "transverse", "length", "width", "thickness", "upper", "lower", "front", "rear", "left", "right", "vertical", "horizontal", "top", "bottom", "inner", "outer", "clockwise", "counterclockwise", "axial", "radial", "circumferential" and the like is based on the orientation or position relationship shown in the figures, which is intended only to facilitate the description of the present invention and simplification of the description instead of indicating or implying that the indicated device or element must have a specific orientation, and be constructed and operated in a specific orientation, and thus should not be construed as a limitation to the present invention.

In addition, the terms "first" and "second" are used for descriptive purposes only and are not to be construed as indicating or implying a relative importance or implicitly indicating the number of technical features indicated. Thus, a feature defined with "first" and "second" may explicitly or implicitly includes one or more of the features. In the description of the present invention, "a plurality of" refers to at least two, such as two, three or the like, unless specified otherwise.

In the present invention, the terms "mounted", "coupled", "connected" and "fixed" should be understood in a broad sense unless otherwise specified and defined, which, for example, may be understood as fixed connection, detachable connection or integral connection; may be understood as mechanical connection or electrical connection, or understood as direct connection, indirect connection via an intermediate medium, or communication between the interiors of two elements or interactions between two elements, unless otherwise specified. The specific meanings of the above terms can be understood in a specific case in the present invention by those of ordinary skill in the art.

In the present invention, unless otherwise specified or defined, by defining that a first feature is disposed "above" or "below" a second feature, it may be meant that the first feature is in direct contact with the second feature, or the first feature is in indirect contact with the second feature via an intermediate medium. In addition, by defining that a first feature is disposed "over" or "above" a second feature, it may be meant that the first feature is rightly over the second feature or is obliquely above the second feature, or the horizontal height of the first feature is greater than that of the second feature. In addition, by defining that a first feature is disposed "under" or "blow, or "beneath" a second feature, it may be meant that the first feature is rightly under the second feature or is obliquely below the second feature, or the horizontal height of the first feature is less than that of the second feature.

It should be understood that when an element is referred to as being "fixed to" or "arranged on" another element, it can be directly on the other element or intervening elements may be present. When an element is referred to as being "connected" to another element, it can be directly connected to the other element or intervening elements may be present. The terms "vertical", "horizontal", "upper", "lower", "left", "right" and other similar expressions used herein are for the purpose of explanation only and do not represent the unique example.

Figure 2:
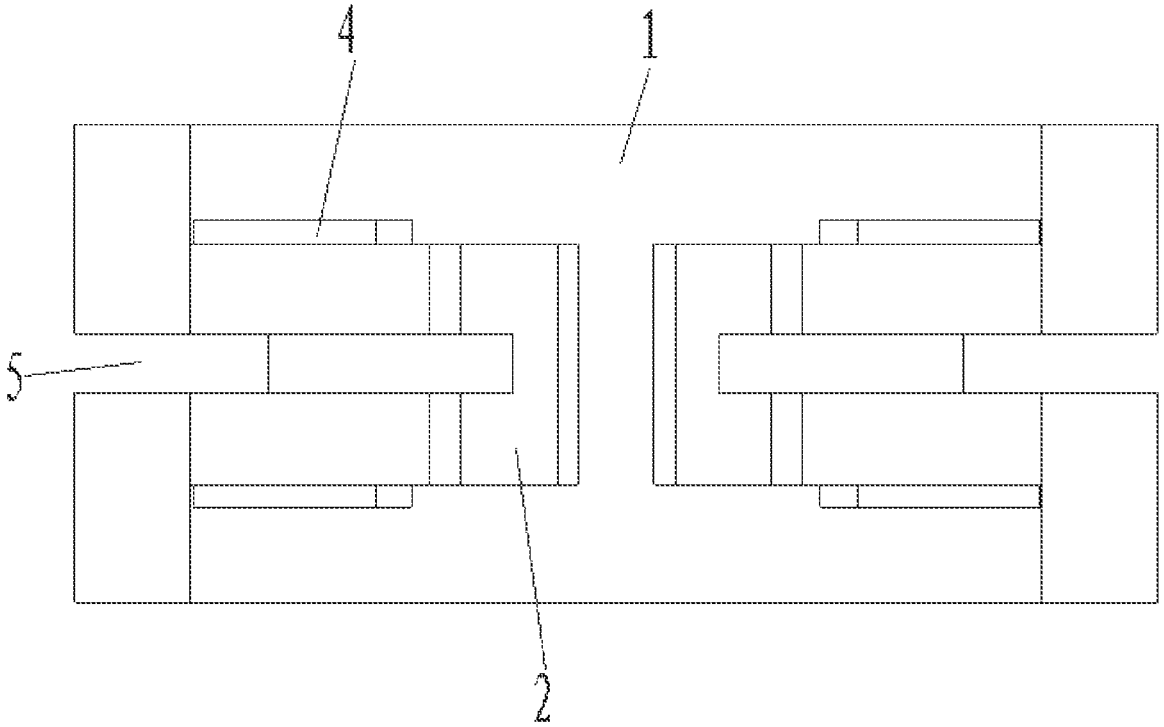
FIG. 2 is a front view of a sealed zipper top stop according to an example of the present invention.

Referring to FIG. 1 to FIG. 2, a sealed zipper top stop provided in an example of the present invention comprises a body 1 and two elastic clamping tongues 2. A groove 11 matched with one end of a slider close to the body 1 is arranged at one side of the body 1 close to the slider. One end of each of the two elastic clamping tongues 2 is arranged at the bottom of the groove 11, and the other end extends towards a direction away from the body 1, and the two elastic clamping tongues 2 are arranged in an inverted splay shape, so that the gap between the two elastic clamping tongues 2 decreases gradually from the end close to the body 1 to the end away from the body 1. Both sides of the body 1 and one side on which the two elastic clamping tongues 2 deviate from each other are provided with clamping grooves 5 extending along the lengthwise direction of the zipper.

In actual use of the sealed zipper top stop, a left tape and a right tape of the zipper pass through the clamping grooves 5 on both sides of the body 1 and one side on which the two elastic clamping tongues 2 deviate from each other respectively, so that the sealed zipper top stop can be pressed and fixed on the left tape and the right tape through the clamping grooves 5; when the slider moves on zipper teeth until the end of the slider close to the body 1 fits closely with the groove 11, the two elastic clamping tongues 2 are inserted into the lead-in inlets on both sides of the top tongue of the slider. The gap between the two elastic clamping tongues 2 decreases gradually from the end close to the body 1 to the end away from the body 1, thus providing a clamping force, making the slider fixed and not easy to loosen.

In this way, the groove 11 matched with the slider is arranged on one side of the body 1 close to the slider, so that the slider can fit closely with the body 1 when moving to the body 1 without creating a gap, and the sealing effect is good. With a compact structure, the sealed zipper top stop can effectively prevent mites and dust from getting in and out or fillers from overflowing when in use, and is thus very suitable for popularization. The two elastic clamping tongues 2 arranged in the groove 11 can be inserted into lead-in inlets on both sides of the top tongue of the slider to clamp and fix the slider, thereby preventing the slider from loosening.

Specifically, in an example, the sealed zipper top stop is a plastic part, so that the two clamping tongues are elastic and can be elastically deformed. The two elastic clamping tongues 2 can be arranged symmetrically about the centerline of the body 1.

In the example of the present invention, each of the two elastic clamping tongues 2 comprises a clamping side 21, and the clamping sides 21 of the two elastic clamping tongues 2 are arranged oppositely; each of the clamping sides 21 comprises a holding section 211, a connecting section 212 and a lead-in section 213, wherein one end of the holding section 211 is connected with the body 1, one end of the connecting section 212 is connected with the other end of the holding section 211, and one end of the lead-in section 213 is connected with the other end of the connecting section 212; a holding space a for holding a top tongue of the slider is formed between the two holding sections 211 and the two connecting sections 212 of the two clamping sides 21, and a lead-in space b for guiding the slider is formed between the two lead-in sections 213 of the two clamping sides 21, and the size of the holding space a is larger than that of the lead-in space b.

Specifically, in an example, the holding sections 211, the connecting sections 212 and the lead-in sections 213 are planar, the two connecting sections 212 are obliquely arranged at the two corresponding holding sections 211 respectively, and ends of the two connecting sections 212 away from the two corresponding holding sections 211 are close to each other. Thus, it is easy to machine the clamping sides 21.

Furthermore, each of the elastic clamping tongues 2 further comprises a lead-in side 22 adjacent to the clamping side 21 and a sidestep side 23 opposite to the clamping side 21, and the width between the sidestep side 23 and the clamping side 21 decreases gradually from the end close to the body 1 to the end away from the body 1. Thus, the width of ends of the elastic clamping tongues 2 away from the body 1 decreases gradually to facilitate the elastic clamping tongues 2 to snap into the slider.

Furthermore, a first arc chamfer 24 is formed between the clamping side 21 and the lead-in side 22, and/or a second arc chamfer 25 is formed between the lead-in side 22 and the sidestep side 23. Thus, the elastic clamping tongues 2 snap into the slider more smoothly.

In an example of the present invention, the cross-sectional shape of the groove 11 is arc. Of course, the cross-sectional shape of the groove 11 can also be V-shaped, square or other irregular shapes without limitation, as long as the groove 11 can match the shape of the upper end of the slider.

In an example of the present invention, the two elastic clamping tongues 2 are provided with guide projections 4 on the upper side and/or the lower side respectively, each of the two guide projections 4 comprises a guide surface 41, and the guide surfaces 41 of the two guide projections 4 are parallel to each other and extend along the lengthwise direction of the zipper. Thus, the movement of the slider can be guided by arranging the guide projections 4 on the upper side and/or the lower side of the two elastic clamping tongues 2 respectively, so as to facilitate the leading-in of the two elastic clamping tongues 2 into the slider.

Furthermore, each of the guide projections 4 further comprises a stop surface 43 perpendicular to the guide surface 41. Thus, each of the guide projections 4 has a right-angle lead-in structure for guiding and limiting the slider.

Furthermore, a third arc chamfer 42 is formed between the guide surface 41 and the stop surface 43 of each of the guide projections 4. Thus, it is easy to guide the guide protrusions 4 into the slider.

In an example of the present invention, the sealed zipper top stop further comprises a stiffener 3, the stiffener 3 is arranged on one side of the body 1 away from the slider and extends along the lengthwise direction of the zipper, and two sides of the stiffener 3 are provided with the clamping grooves 5 for tapes to pass through. Thus, the length of the sealed zipper top stop along the lengthwise direction of the zipper is longer, and the connection between the sealed zipper top stop and tapes can be strengthened by arranging the stiffener 3.

The present invention further provides a zipper, comprising a left tape, a right tape, left zipper teeth, right zipper teeth, a slider and a sealed zipper top stop according to any of the above examples, wherein the left tape and the right tape are arranged in parallel at an interval; the left zipper teeth are arranged at one side of the left tape close to the right tape, the right zipper teeth are arranged at one side of the right tape close to the left tape, and the slider is connected with the left zipper teeth and the right zipper teeth; the sealed zipper top stop is connected with the left tape and the right tape and is located at an end of the zipper.

The technical features of the above examples can be combined in any way. For brevity, not all possible combinations of the technical features of the above examples are described. However, it should be considered that the technical features are included in the scope of the specification provided that there is no contradiction in the combinations thereof.

The above examples illustrate several examples of the present invention only, but should not be construed as limiting the scope of the present invention despite of specific and detailed description. It should be noted that those of ordinary skill in the art can make various changes and improvements without departing from the concept of the invention, which should be incorporated in the protection scope of the present invention. Therefore, the protection scope of the present invention shall be subject to appended claims.

The invention claimed is:

1. A sealed zipper top stop, characterized by comprising:

a body, wherein a groove matched with one end of a slider close to the body is arranged at one side of the body close to the slider; and two elastic clamping tongues, wherein one end of each of the two elastic clamping tongues is arranged at a bottom of the groove, and the other end another end of each of the elastic clamping tongues extends towards a direction away from the body, and the two elastic clamping tongues are arranged in an inverted splay shape, so that a gap between the two elastic clamping tongues decreases gradually from an end close to the body to an end away from the body;

wherein both sides of the body and one side on which the two elastic clamping tongues deviate from each other are provided with clamping grooves.

2. The sealed zipper top stop according to claim 1, characterized in that each of the two elastic clamping tongues comprises a clamping side, and the clamping sides of the two elastic clamping tongues are arranged oppositely; each of the clamping sides comprises a holding section, a connecting section and a lead-in section, wherein one end of the holding section is connected with the body, one end of the connecting section is connected with another end of the holding section, and one end of the lead-in section is connected with another end of the connecting section; a holding space for holding a top tongue of the slider is formed between the two holding sections and the two connecting sections of the two clamping sides, and a lead-in space for guiding the slider is formed between the two lead-in sections of the two clamping sides, and the size of the holding space is larger than that of the lead-in space.

3. The sealed zipper top stop according to claim 2, characterized in that the holding sections, the connecting sections and the lead-in sections are planar, the two connecting sections are obliquely arranged at the two corresponding holding sections respectively, and ends of the two connecting sections away from the two corresponding holding sections are close to each other.

4. The sealed zipper top stop according to claim 2, characterized in that each of the elastic clamping tongues further comprises a lead-in side adjacent to the clamping side and a sidestep side opposite to the clamping side, and the width between the sidestep side and the clamping side decreases gradually from the end close to the body to the end away from the body.

5. The sealed zipper top stop according to claim 4, characterized in that a first arc chamfer is formed between the clamping side and the lead-in side, and/or a second arc chamfer is formed between the lead-in side and the sidestep side.

6. The sealed zipper top stop according to claim 1, characterized in that each of the two elastic clamping tongues is provided with guide projections on an upper side thereof and/or a lower side thereof respectively, each of the two guide projections comprises a guide surface, and the guide surfaces of the two guide projections are parallel to each other.

7. The sealed zipper top stop according to claim 6, characterized in that each of the guide projections further comprises a stop surface perpendicular to the guide surface.

8. The sealed zipper top stop according to claim 1, characterized by further comprising:

a stiffener, arranged on one side of the body away from the slider, two sides of the stiffener are provided with the clamping grooves.

* * * * *